US006680573B1

(12) United States Patent
Kim et al.

(10) Patent No.: US 6,680,573 B1
(45) Date of Patent: Jan. 20, 2004

(54) PLASMA DISPLAY PANEL WITH IMPROVED ILLUMINANCE

(75) Inventors: Jae Sung Kim, Kyongsangbuk-do (KR); Chung Huan Jeon, Kyongsangbuk-do (KR); Eun Cheol Lee, Kyongsangbuk-do (KR); Young Joon Ahn, Kyongsangbuk-do (KR); Seok Dong Kang, Kyongsangbuk-do (KR); Sung Yong Ahn, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 335 days.

(21) Appl. No.: 09/625,636

(22) Filed: Jul. 25, 2000

(30) Foreign Application Priority Data

Jul. 26, 1999 (KR) ..... 99-30456
Jul. 26, 1999 (KR) ..... 99-30457
Jul. 26, 1999 (KR) ..... 99-30458

(51) Int. Cl.[7] ..... H01J 17/49; H01J 17/00; H01J 61/00; H01J 1/46; H01J 21/10

(52) U.S. Cl. ..... 313/586; 313/583; 313/584; 313/587; 313/590; 313/505; 313/300

(58) Field of Search ..... 313/583, 584, 313/585, 586, 587, 590, 300, 505

(56) References Cited

U.S. PATENT DOCUMENTS 3,801,851 A * 4/1974 Andoh et al. ..... 313/586
5,841,232 A * 11/1998 Hirao et al. ..... 313/585
6,118,214 A * 9/2000 Marcotte ..... 313/582
6,195,070 B1 * 2/2001 Shinoda et al. ..... 313/485
6,211,614 B1 * 4/2001 Katayama et al. ..... 313/582
6,339,288 B1 * 1/2002 Qian et al. ..... 313/498
6,348,762 B1 * 2/2002 Nunomura et al. ..... 313/582
6,411,032 B1 * 6/2002 Shiiki et al. ..... 313/485
6,531,995 B2 * 3/2003 Ishii et al. ..... 345/67

FOREIGN PATENT DOCUMENTS

JP 8-77930 3/1996

* cited by examiner

*Primary Examiner*—Nimeshkumar D. Patel
*Assistant Examiner*—Matt Hodges
(74) *Attorney, Agent, or Firm*—Fleshner & Kim, LLP

(57) ABSTRACT

A plasma display panel having higher light-emitting luminance and efficiency of a discharge cell includes: a plurality of first barriers successively formed on a substrate at predetermined intervals; a plurality of first sustain electrodes formed at a width more than 40% of a pixel pitch, which is an overall distance of four of the barriers, to be orthogonal to the first barriers; a plurality of second sustain electrodes spaced apart from the first sustain electrodes at a distance less than 20% of the pixel pitch and mated with the first sustain electrodes one by one; a dielectric layer formed at a thickness of 25 $\mu$m or more to cover the first and second sustain electrodes; and a plurality of pads formed on some of the dielectric layer corresponding to the first sustain electrodes and the second sustain electrodes in each discharge cell.

17 Claims, 18 Drawing Sheets

PLASMA DISPLAY PANEL WITH IMPROVED ILLUMINANCE

BACKGROUND OF THE INVENTION

1. Field of the Invention

The present invention relates to a plasma display panel, and more particularly, to a plasma display panel which expands a discharge space and restricts discharge current.

2. Discussion of the Related Art

Generally, a plasma display panel and a liquid crystal display (LCD) have lately attracted considerable attention as the most practical next generation display of flat panel displays. In particular, the plasma display panel has higher luminance and a wider viewing angle than the LCD. For this reason, the plasma display panel is widely used as a thin type large display such as an outdoor advertising tower, a wall TV and a theater display.

A related art plasma display panel of three-electrode area discharge type will be described with reference to the accompanying drawings.

FIG. 1 is a perspective view of a related art plasma display panel of three-electrode area discharge type, and FIG. 2 is a structural sectional view of the plasma display panel of FIG. 1.

As shown in FIGS. 1 and 2, the related art plasma display panel of three-electrode area discharge type includes an upper substrate 10 and a lower substrate 20 which face each other. In FIG. 2, the lower substrate 20 is rotated by 90°.

The upper substrate 10 includes a plurality of scan electrodes 16 and 16', a plurality of sustain electrodes 17 and 17', a dielectric layer 11, and a protection layer 12. The scan electrodes 16 and 16' are formed at certain intervals in one direction in parallel to the sustain electrodes 17 and 17'. The dielectric layer 11 is deposited on the scan electrodes 16 and 16' and the sustain electrodes 17 and 17'.

The lower substrate 20 includes a plurality of address electrodes 22 formed at certain intervals in one direction (orthogonal to the scan electrodes and the sustain electrodes) in parallel to one another, a dielectric film 21 formed on an entire surface of the substrate including the address electrodes 22, a plurality of barriers 23 formed on the dielectric film 21 between the respective address electrodes, and a phosphor 24 formed on surfaces of the barriers 23 in each discharge cell and of the dielectric film 21.

Inert gases such as He and Xe are mixed in a space between the upper substrate. 10 and the lower substrate 20 at a pressure of 400 to 500 Torr. The space forms a discharge area.

The scan electrodes 16 and 16' and the sustain electrodes 17 and 17' are of transparent electrodes and bus electrodes of metals so as to increase optical transmitivity of each discharge cell, as shown in FIGS. 3 and 4. That is to say, the electrodes 16 and 17 are of transparent electrodes while the electrodes 16' and 17' are of bus electrodes.

A discharge voltage from an externally provided driving integrated circuit(IC) is applied to the bus electrodes 16' and 17'. The discharge voltage applied to the bus electrodes 16' and 17' is applied to the transparent electrodes 16 and 17 to generate discharge between the adjacent transparent electrodes 16 and 17. The transparent electrodes 16 and 17 have an overall width of about 300 $\mu$m and are made of indium oxide or tin oxide. The bus electrodes 16' and 17' are formed of a three-layered thin film of Cr-Cu-Cr. At this time, the bus electrodes 16' and 17' have a line width of ⅓ of a line width of the transparent electrodes 16 and 17.

The operation of the aforementioned AC type plasma display panel of three-electrode area discharge type will be described with reference to FIGS. 5*a* to 5*d*.

If a driving voltage is applied between each address electrode and each scan electrode, opposite discharge occurs between the address electrode and the scan electrode as shown in FIG. 5*a*. The inert gas injected into the discharge cell is instantaneously excited by the opposite discharge. If the inert gas is again transited to the ground state, ions are generated. The generated ions or some electrons of quasi-excited state come into collision with a surface of the protection layer as shown in FIG. 5*b*. The collision of the electrons secondarily discharges electrons from the surface of the protection layer. The secondarily discharged electrons come into collision with a plasma gas to diffuse the discharge. If the opposite discharge between the address electrode and the scan electrode ends, wall charges having opposite polarities occur on the surface of the protection layer on the respective address electrode and the scan electrode.

If the discharge voltages having opposite polarities are continuously applied to the scan electrode and the sustain electrode and at the same time the driving voltage applied to the address electrode is cut off, area discharge occurs in a discharge area on the surfaces of the dielectric layer and the protection layer due to potential difference between the scan electrode and the sustain electrode as shown in FIG. 5*d*. The electrons in the discharge cell come into collision with the inert gas in the discharge cell due to the opposite discharge and the area discharge. As a result, the inert gas in the discharge cell is excited and ultraviolet rays having a wavelength of 147nm occur in the discharge cell. The ultraviolet rays come into collision with the phosphors surrounding the address electrode and the barrier so that the phosphors are excited. The excited phosphors generate visible light rays, and the visible light rays display an image on a screen. That is, the plasma display panel is operated.

At this time, luminance of the plasma display panel is proportional to discharge current between the scan electrode and the sustain electrode. Accordingly, if the discharge current is great, the screen of the plasma display panel becomes bright. Also, the wider the distance between the scan electrode and the sustain electrode is, the higher luminance of the plasma display panel is. This is because that the discharge distance between the electrodes increases so that ultraviolet rays in a positive column region are generated.

A white colored screen displayed by the plasma display panel is determined by luminance ratio of a red discharge cell, a green discharge cell and a blue discharge cell. At this time, picture quality of the white colored screen becomes clearer if a color temperature is high.

However, since the related art plasma display panel has lower luminance than that of a discharge tube such as a fluorescent lamp and a neon lamp, it is not sufficient for a next generation display device to substitute a CRT. This is because that the discharge cell formed in the related art plasma display panel has a short distance between the discharge electrodes as compared with a discharge tube such as a neon lamp and a fluorescent lamp, thereby resulting in that ultraviolet rays in a positive column region having good light-emitting efficiency are not utilized.

Furthermore, the related art plasma display panel has a problem that picture quality of a white colored screen is poor because the luminance ratio of the red discharge cell, the green discharge cell and the blue discharge cell is different.

SUMMARY OF THE INVENTION

Accordingly, the present invention is directed to a plasma display panel that substantially obviates one or more of the problems due to limitations and disadvantages of the related art.

An object of the present invention is to provide a plasma display panel having higher light-emitting luminance and efficiency.

Another object of the present invention is to provide a plasma display panel in which a white colored screen has an improved picture quality by preventing crosstalk from occurring and by controlling luminance ratio of each discharge cell.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a plasma display panel according to the present invention includes: a plurality of first barriers successively formed on a substrate at constant intervals; a plurality of first sustain electrodes successively formed at a width more than 40% of a pixel pitch, which is an overall distance of four of the first barriers, to be orthogonal to the first barriers; a plurality of second sustain electrodes spaced apart from the first sustain electrodes at a distance less than 20% of the pixel pitch and mated with the first sustain electrodes one by one; and a dielectric layer formed at a thickness of 25 $\mu$m or more to cover the first and second sustain electrodes.

In another aspect, a plasma display panel according to the present invention includes: a plurality of first barriers successively formed on a substrate at predetermined intervals; a plurality of first sustain electrodes formed at a width more than 40% of a pixel pitch, which is an overall distance of four of the barriers, to be orthogonal to the first barriers; a plurality of second sustain electrodes spaced apart from the first sustain electrodes at a distance less than 20% of the pixel pitch and mated with the first sustain electrodes one by one; a dielectric layer formed at a thickness of 25 $\mu$m or more to cover the first and second sustain electrodes; and a plurality of conductive materials formed on some of the dielectric layer corresponding to the first sustain electrodes and the second sustain electrodes in each discharge cell.

In other aspect, a plasma display panel according to the present invention is characterized in that a sustain electrode formed in each discharge cell is wider than the related art sustain electrode, a dielectric layer on the sustain electrode is thicker than the related art dielectric layer, and conductive pads are formed on the dielectric layer to have different sizes for each discharge cell.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Reference will now be made in detail to the preferred embodiments of the present invention, examples of which are illustrated in the accompanying drawings.

First Embodiment

Figure 1:
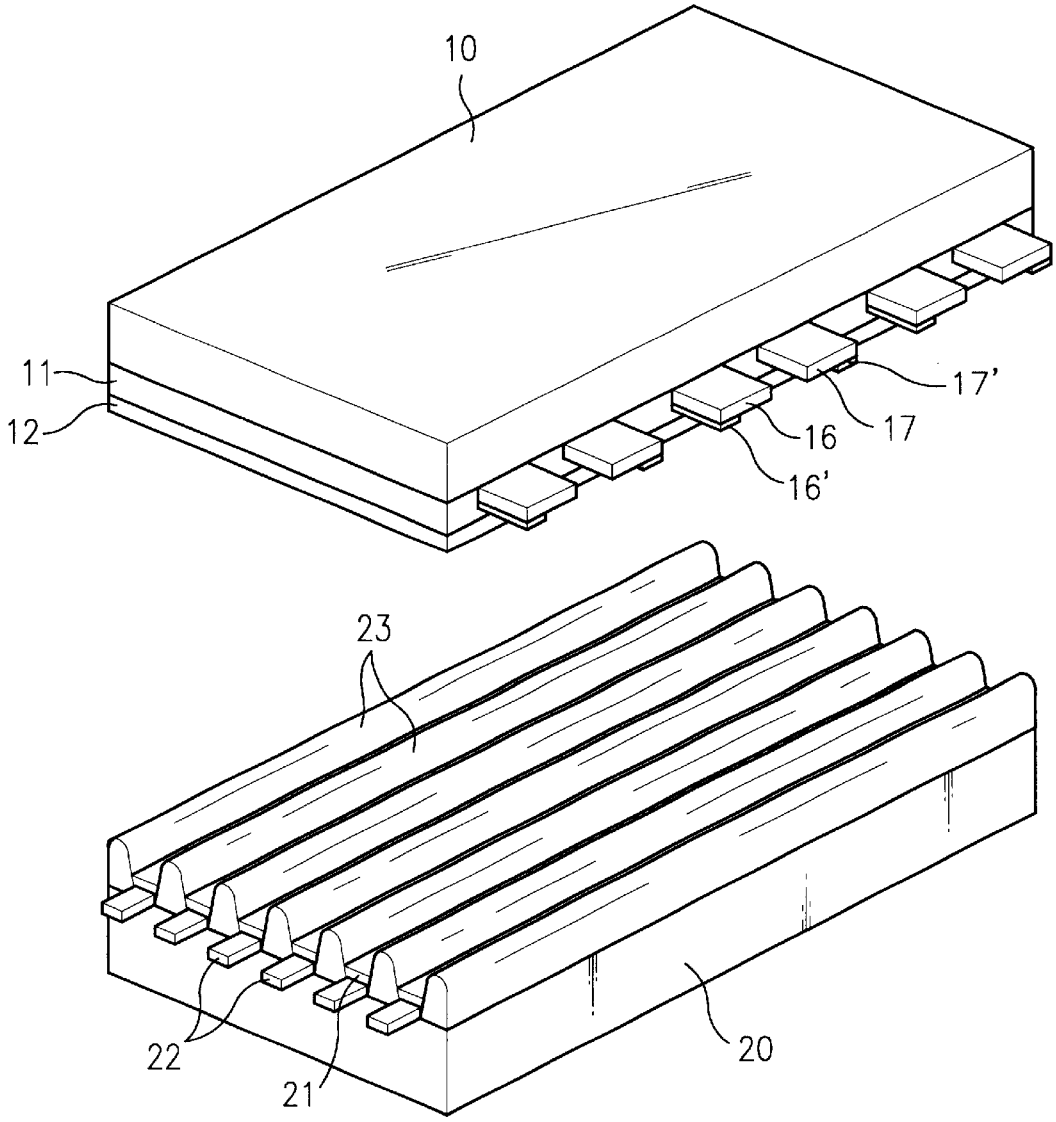
FIG. 1 Prior Art
FIG. 1 is a perspective view of a general plasma display panel.
Figure 2:
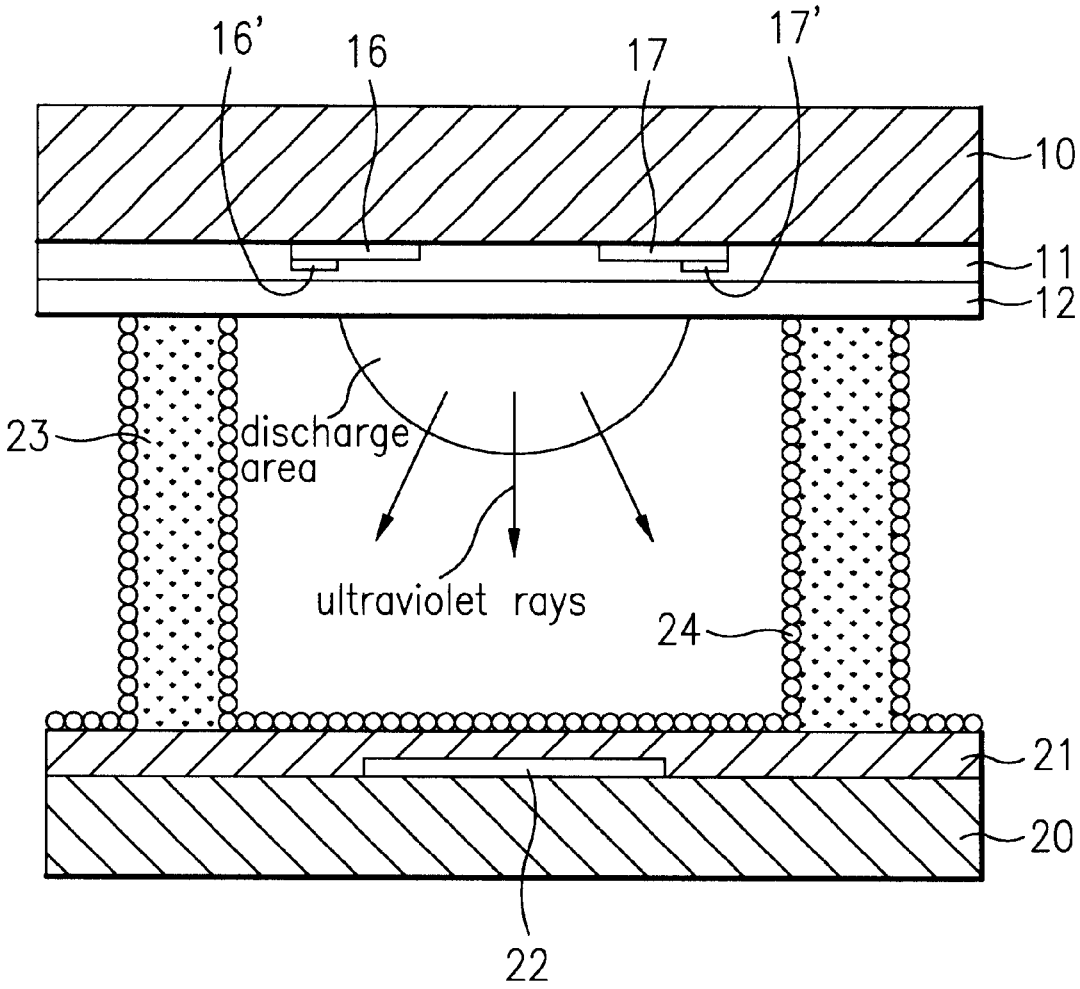
FIG. 2 Prior Art
FIG. 2 is a sectional view of the general plasma display panel of FIG. 1.
Figure 3:
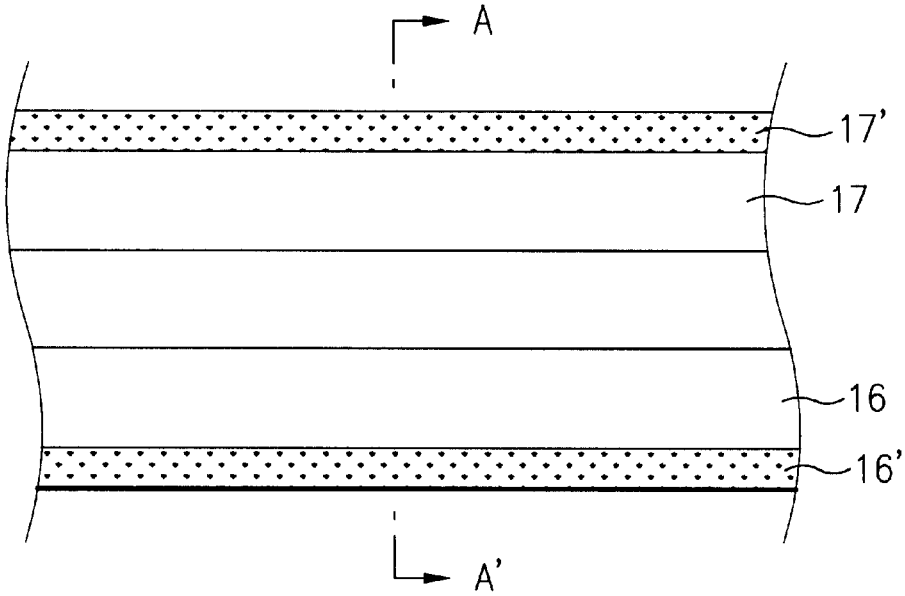
FIG. 3 Prior Art
FIG. 3 is a plane view of a sustain electrode formed on an upper substrate of a related art plasma display panel.
Figure 4:
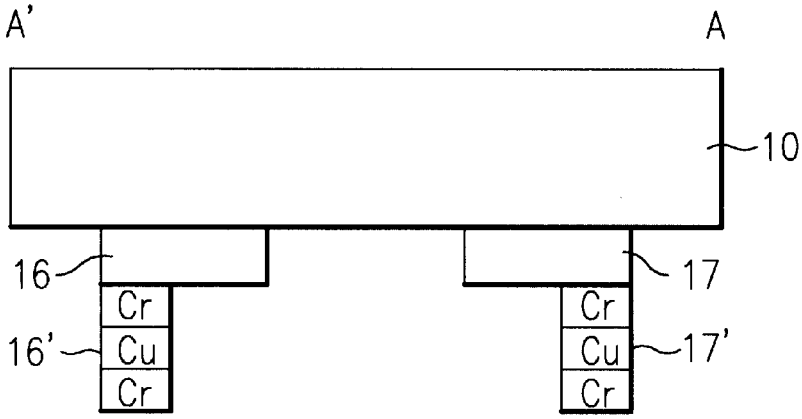
FIG. 4 Prior Art
FIG. 4 is a sectional view of a sustain electrode formed on the upper substrate of FIG. 3.
Figure 5A:
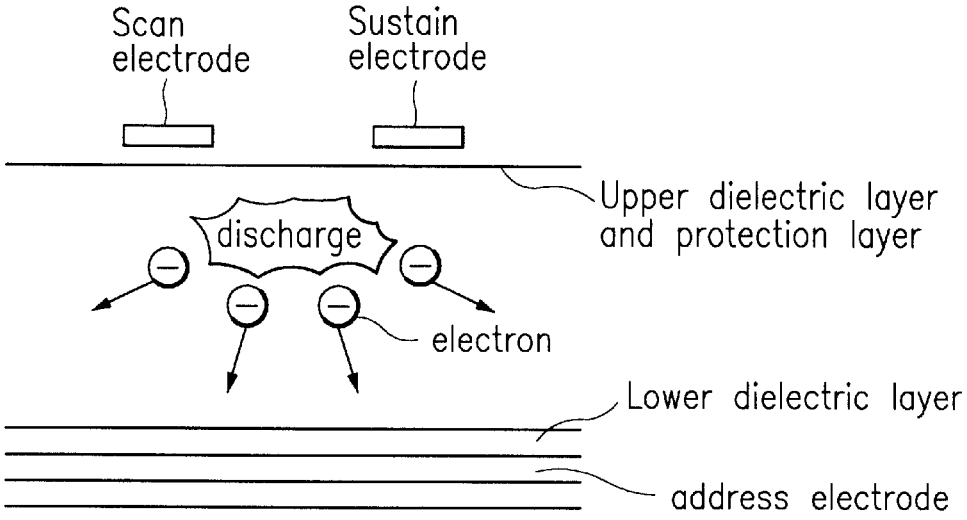
FIG. 5A Prior Art
FIGS. 5*a* to 5*d* are sectional views illustrating the operation of a discharge cell in a writing discharge section of the related art plasma display panel.
Figure 5B:
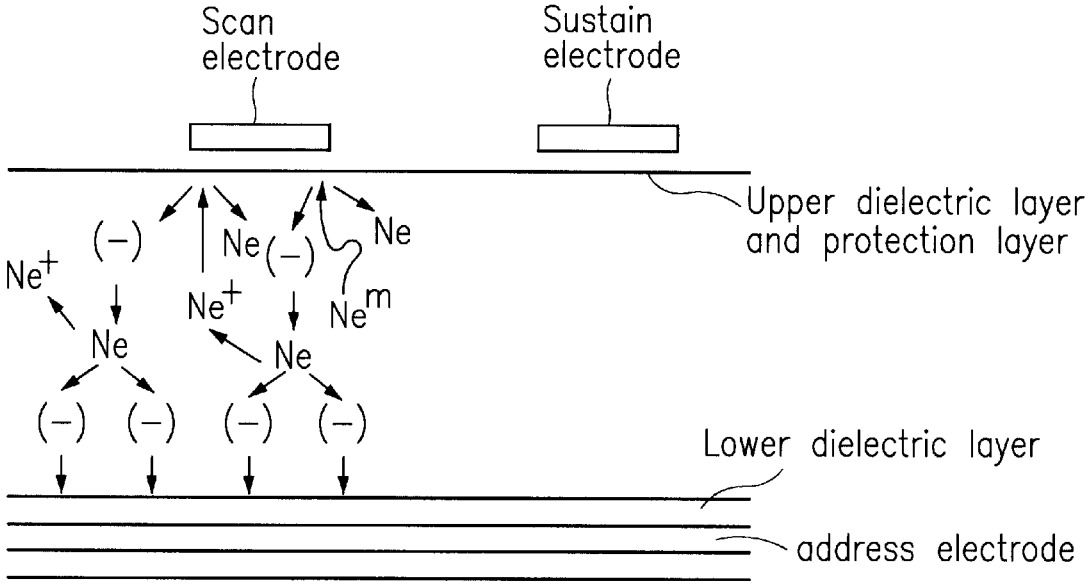
FIG. 5B Prior Art
Figure 5C:
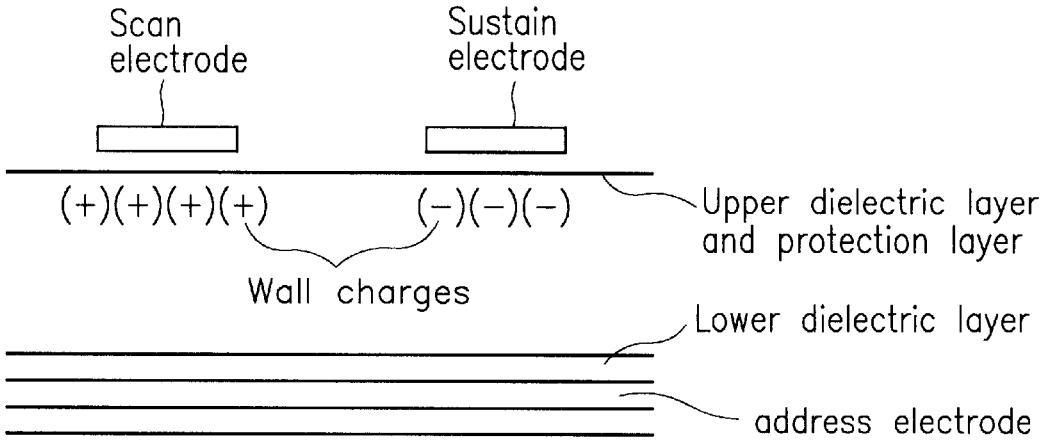
FIG. 5C Prior Art
Figure 5D:
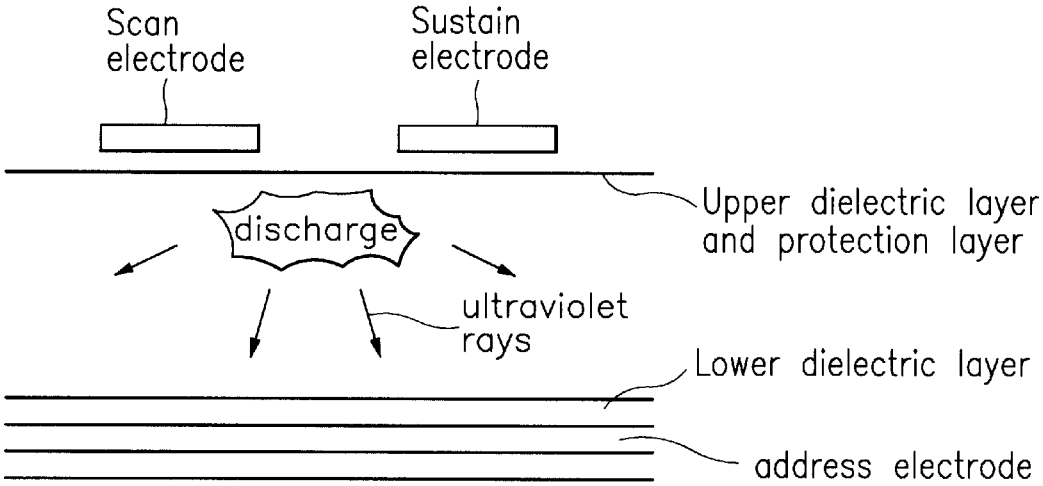
FIG. 5D Prior Art
Figure 6:
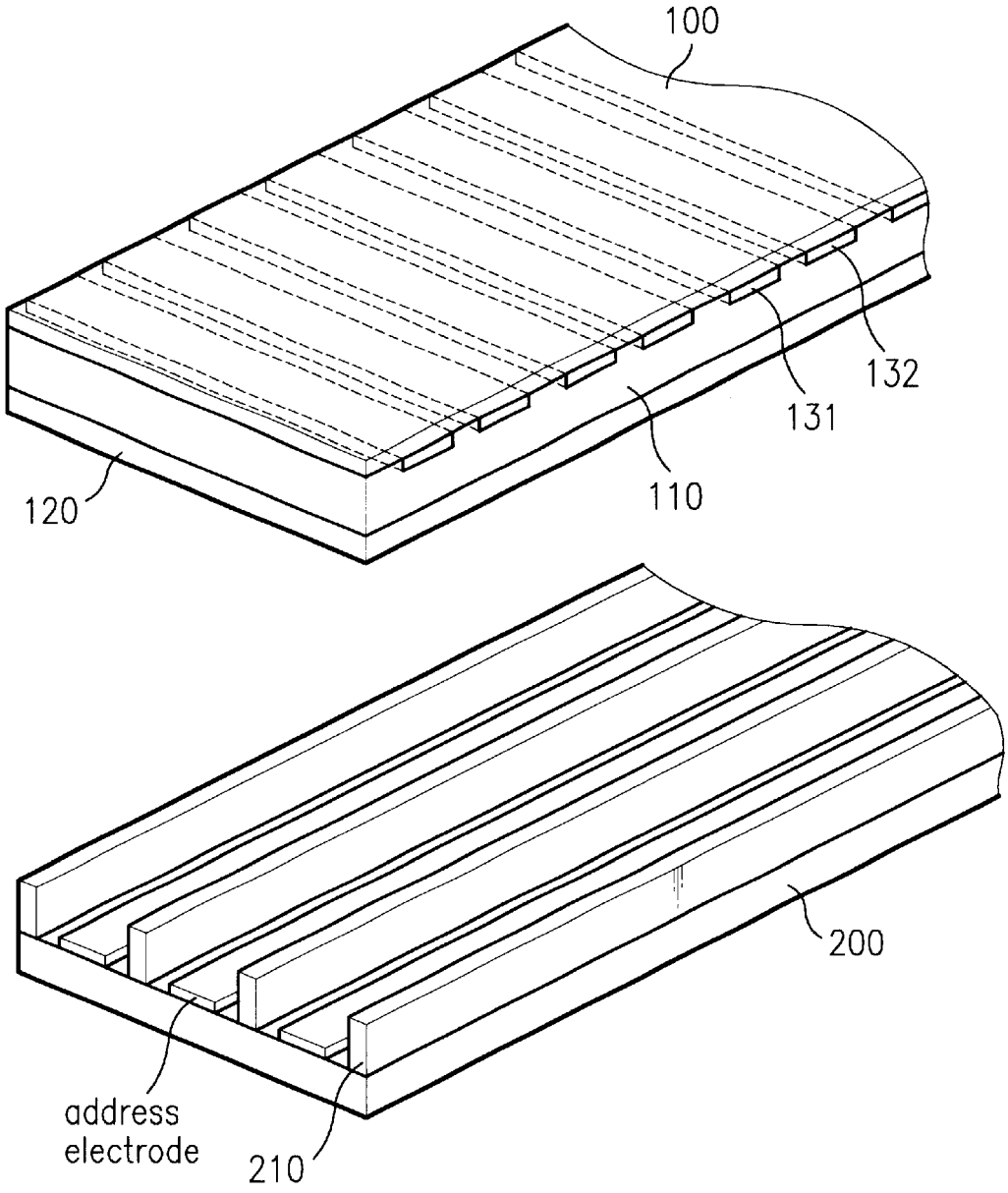
FIG. 6 is a perspective view illustrating a plasma display panel according to the first embodiment of the present invention.

A plasma display panel according to the first embodiment of the present invention will be described with reference to FIG. 6.

In the same manner as a general plasma display panel, barriers are successively formed on a predetermined substrate at constant intervals. The barriers are generally formed on a lower substrate 200 but they may be formed on an upper substrate 100 as the case may be. Also, it is general that the barriers have stripe shapes. However, the barriers may have lattice shapes. Address electrodes are formed between the respective barriers in parallel to the barriers.

A plurality of first sustain electrodes 132 and second sustain electrodes 131 are successively formed at predetermined widths to be respectively orthogonal to the barriers. At this time, the first sustain electrodes 132 are mated with the second sustain electrodes 131 one by one. A pair of the first and second sustain electrodes 132 and 131 are separated from another pair of adjacent sustain electrodes by the barriers.

Preferably, the first sustain electrodes 132 have the same width as that of the second sustain electrodes 131. The first sustain electrodes 132 and the second sustain electrodes 131 should have the width more than 40% of an overall distance of four barriers among the barriers. Also, the distance between the first sustain electrode 132 and the second sustain electrode 131 adjacent to each other has a value less than 20% of the overall distance of four barriers.

The overall distance of four barriers is equal to the size(or pitch) of one pixel of a plasma display panel. This is the reason why that three discharge areas are formed among four barriers to form a red discharge cell, a green discharge cell and a blue discharge cell. Accordingly, the distance of the four barriers is equal to the size of one pixel. In the present invention, the overall distance of the four barriers means one pixel pitch.

In the plasma display panel of the present invention, 80% or more(preferably, 90%) of the pixel pitch are filled with the sustain electrodes. As a result, the pixel region in the plasma display panel is formed with the sustain electrodes in the range of 80% or greater.

If the sustain electrode becomes wider, the discharge area becomes wider, thereby improving light-emitting luminance. However, there is a problem that the amount of discharge current increases. To solve this problem, the plasma display panel of the present invention includes a dielectric layer 110 thicker than the related art one. In this case, a protection layer 120 of MgO is formed to prevent degradation of the dielectric layer and to improve discharge efficiency.

Figure 19:
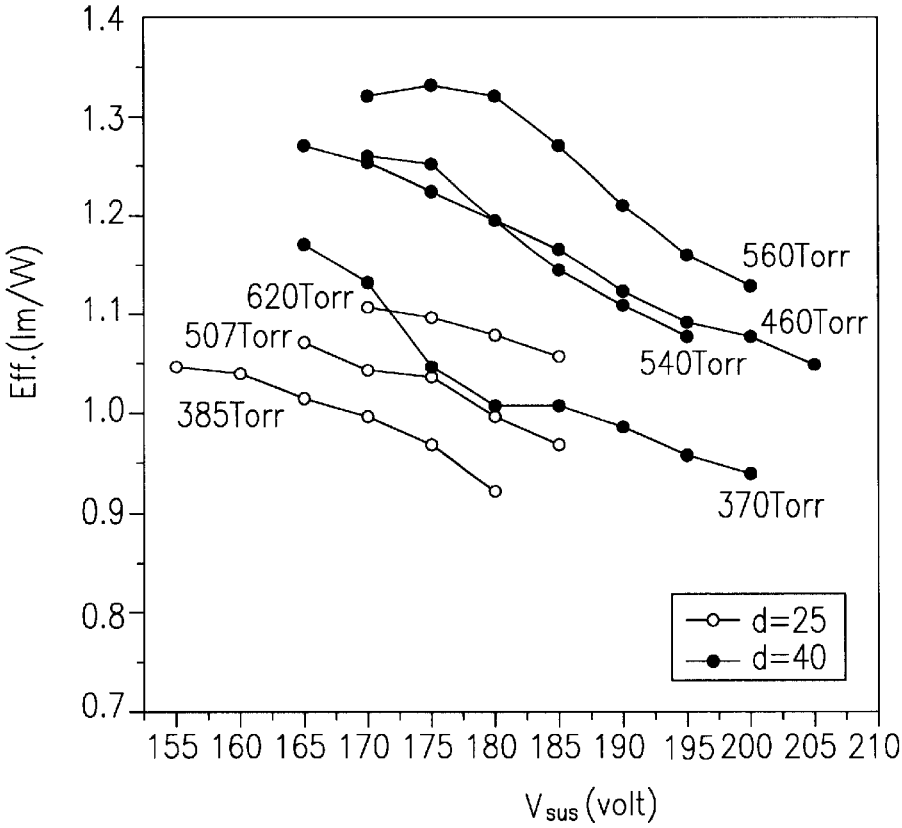
FIG. 19 is a graph illustrating light-emitting efficiency according to a thickness of a dielectric layer and gas pressure.

The dielectric layer 110 in the plasma display panel of the present invention is deposited on the first sustain electrodes 132 and the second sustain electrodes 131 at a thickness of 25 $\mu$m or greater. The plasma display panel is characterized in that the discharge current increases if the sustain electrode becomes wider while the discharge current decreases if the dielectric layer 110 becomes thicker. It is noted, in a graph of FIG. 19, that the plasma display panel of 40 $\mu$m has higher light-emitting efficiency than the plasma display panel of 25 $\mu$m on a condition of the same voltage.

Figure 20:
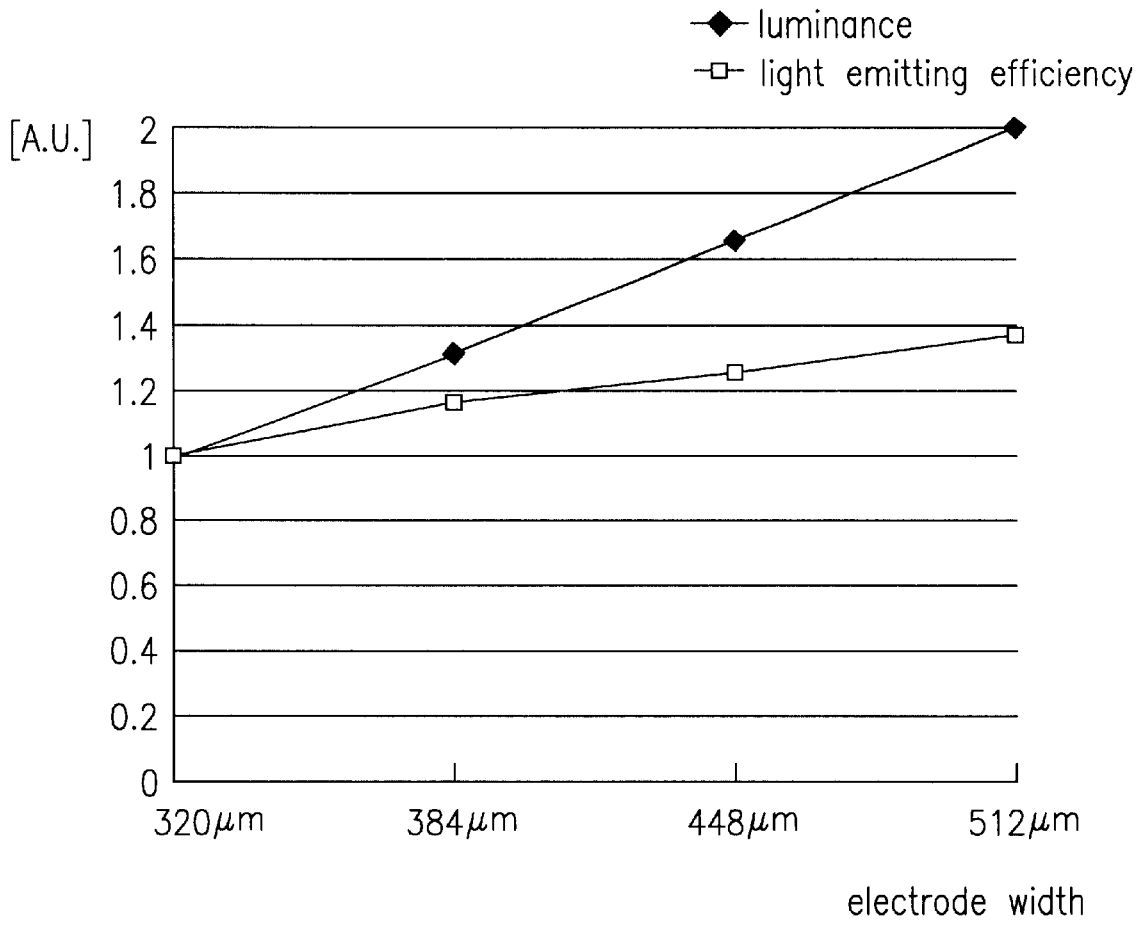
FIG. 20 is a graph illustrating luminance and light-emitting efficiency of a sustain electrode according to a width of a sustain electrode.

FIG. 20 is a graph illustrating luminance and light-emitting efficiency depending on the width of the electrode. As shown in FIG. 20, it is noted that luminance and light-emitting efficiency of the discharge cell increase if the width of the sustain electrode become wider.

Therefore, in the plasma display panel of the present invention, the sustain electrode becomes wide to increase luminance of the discharge cell, and the dielectric layer 110 is thickly formed to decrease the amount of discharge current increased by the widen sustain electrode.

The aforementioned plasma display panel can be realized by various embodiments according to arrangement relationship of the sustain electrodes.

Second Embodiment

Figure 7:
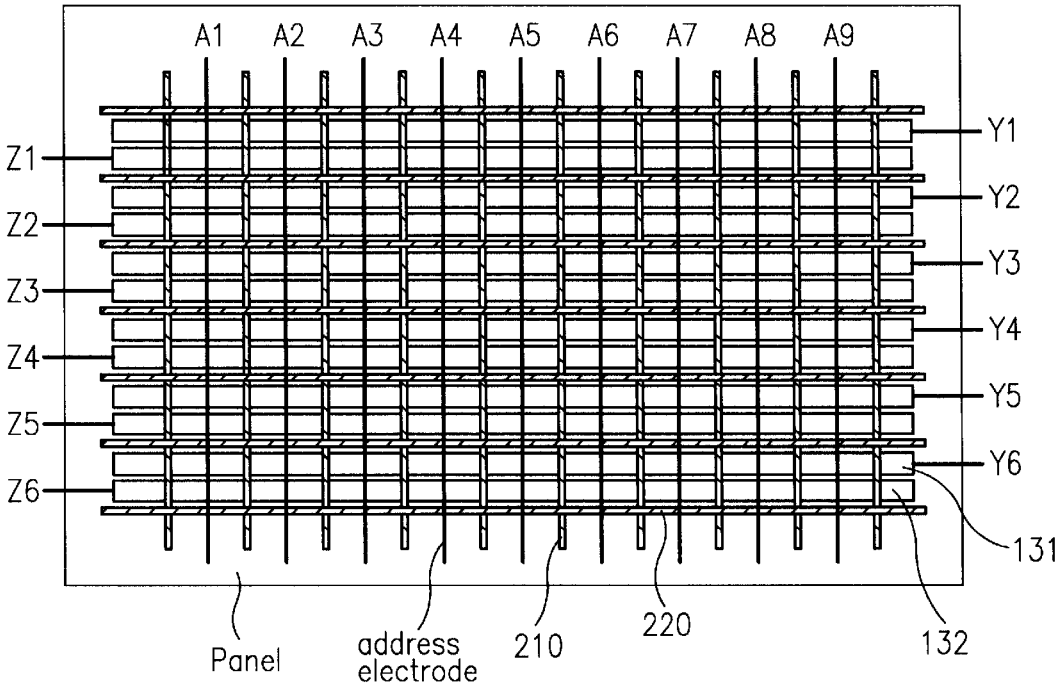
FIG. 7 is a layout illustrating a plasma display panel according to the second embodiment of the present invention.

FIG. 7 is a layout illustrating a plasma display panel according to the second embodiment of the present invention.

In the second embodiment of the present invention, the first sustain electrodes 132 and the second sustain electrodes 131 are alternately formed with the structure as described in the first embodiment of the present invention.

The barrier generally has a stripe shape in the first embodiment of the present invention. However, in the second embodiment of the present invention, the barrier has a lattice shape as shown in FIG. 7.

The lattice-shaped barrier includes a first barrier 210 formed in parallel to the sustain electrode, and a second barrier 220 successively formed to be orthogonal to the first barrier 210.

Thus, a scan pulse is applied to the first sustain electrode 132, and a sustain pulse is applied to the second sustain electrode 131.

In FIG. 7, Y1, Y2, Y3, Y4, Y5, Y6, Y7, Y8, Y9, . . . denote the first sustain electrodes, and Z1, Z2, Z3, Z4, Z5, Z6, Z7, Z8, Z9, . . . denote the second sustain electrodes.

Third Embodiment

Figure 8:
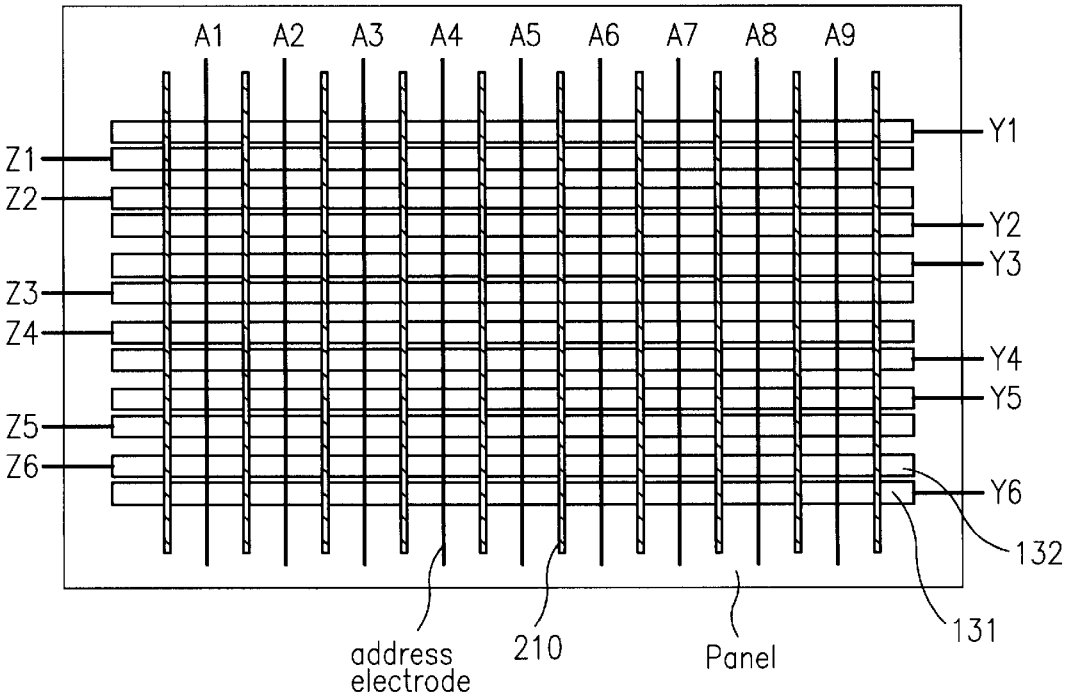
FIG. 8 is a layout illustrating a plasma display panel according to the third embodiment of the present invention.

FIG. 8 is a layout illustrating a plasma display panel according to the third embodiment of the present invention.

In the third embodiment of the present invention, the first sustain electrodes 132 are mated with the second sustain electrodes 131 one by one, and the same sustain electrodes are adjacent to each other between adjacent pairs of the sustain electrodes. That is, in the plasma display panel according to the first and second embodiments of the present invention, the first sustain electrodes 132 and the second sustain electrodes 131 are alternately formed. On the other hand, in the plasma display panel according to the third embodiment of the present invention, a pair of sustain electrodes formed in one discharge cell are alternately formed and a barrier has a stripe shape.

In FIG. 8, Y1, Y2, Y3, Y4, Y5, Y6, Y7, Y8, Y9, . . . denote the first sustain electrodes, and Z1, Z2, Z3, Z4, Z5, Z6, Z7, Z8, Z9, . . . denote the second sustain electrodes.

If a scan pulse is applied to the first sustain electrode 132 and a sustain pulse is applied to the second sustain electrode 131, the first sustain electrode 132 and the second sustain electrode 131 in the plasma display panel according to the third embodiment of the present invention are adjacent to each other as shown in FIG. 8. If a pair of sustain electrodes formed in a discharge cell are formed in the order of the first sustain electrode 132 and the second sustain electrode 131, a pair of the sustain electrodes in another adjacent discharge cell are formed in the order of the second sustain electrode 131 and the first sustain electrode 132.

However, in the plasma display panel according to the third embodiment of the present invention, the first sustain electrode 132 and the second sustain electrode 131 constitute a pair. The distance between the first sustain electrode and the second sustain electrode is closer than the distance between adjacent pairs. The barriers 210 act to isolate a pair consisting of the first sustain electrode 132 and the second sustain electrode 131 from adjacent pairs. The pair consisting of the first sustain electrode 132 and the second sustain electrode 131 constitutes a discharge cell. The respective discharge cells are isolated from one another by the barriers 210.

Fourth Embodiment

Figure 9:
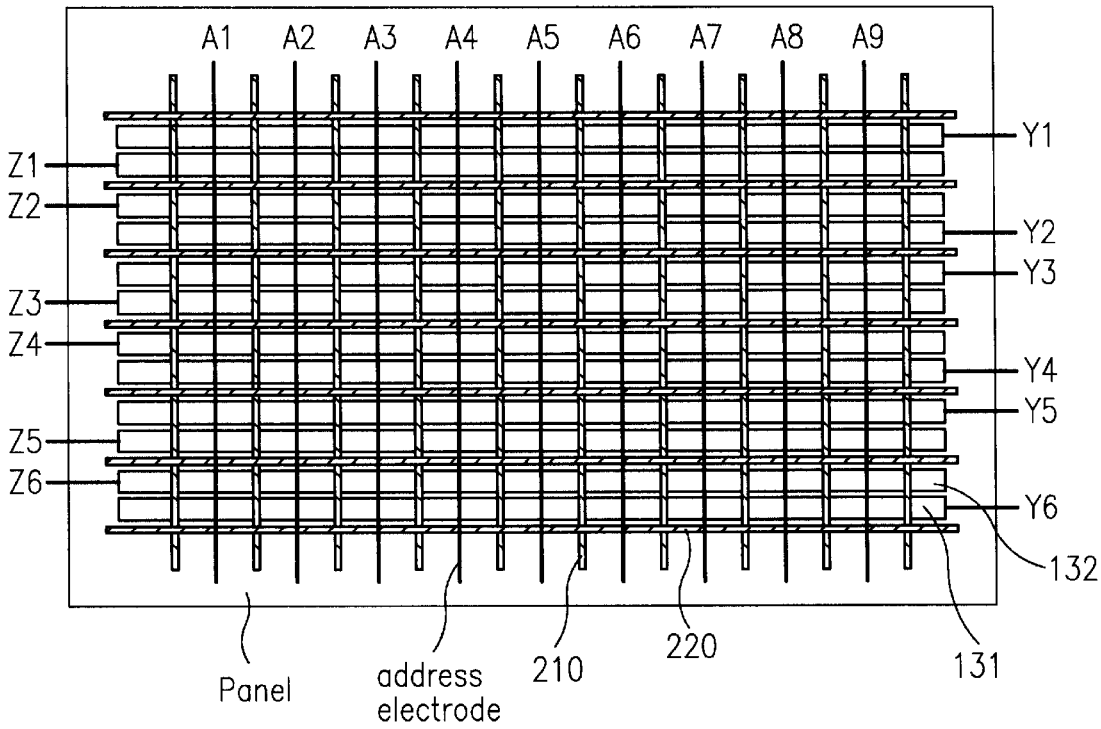
FIG. 9 is a layout illustrating a plasma display panel according to the fourth embodiment of the present invention.

FIG. 9 is a layout illustrating a plasma display panel according to the fourth embodiment of the present invention.

The fourth embodiment of the present invention is similar to the third embodiment of the present invention. In the fourth embodiment of the present invention, the barrier has a lattice shape as shown in FIG. 9. The lattice shaped barrier includes a first barrier 210 formed in parallel to the sustain electrode, and a second barrier 220 successively formed between the respective first barriers 210 to be orthogonal to the first barrier 210.

In FIG. 9, Y1, Y2, Y3, Y4, Y5, Y6, Y7, Y8, Y9, . . . denote the first sustain electrodes, and Z1, Z2, Z3, Z4, Z5, Z6, Z7, Z8, Z9, . . . denote the second sustain electrodes.

Fifth Embodiment

Figure 10:
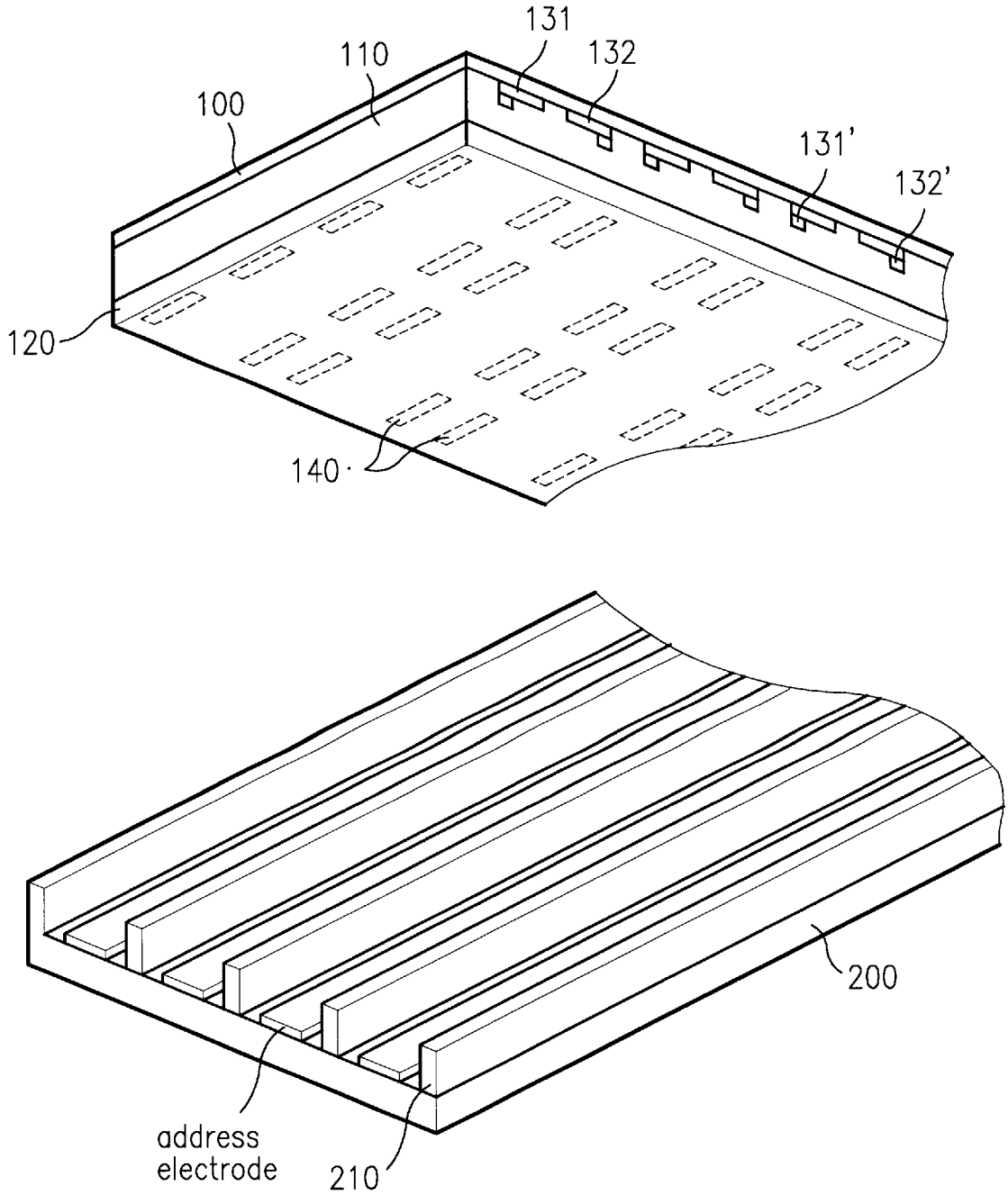
FIG. 10 is a perspective view illustrating a plasma display panel according to the fifth embodiment of the present invention.

FIG. 10 is a perspective view illustrating a plasma display panel according to the fifth embodiment of the present invention.

In the fifth embodiment of the present invention, arrangement of the first and second sustain electrodes and a lattice shaped structure are similar to the first embodiment of the present invention. In the fifth embodiment of the present invention, if the width of the sustain electrode becomes wider, the distance between adjacent sustain electrodes becomes smaller. In this case, crosstalk may occur. To solve this problem, pads 140 of a conductive material are further formed on the dielectric layer 110 of the upper substrate 100 at a uniform size.

The first and second sustain electrodes include transparent electrodes 131 and 132 having predetermined widths, and metal electrodes 131' and 132' having smaller widths than the transparent electrodes 131 and 132 to partially overlap the transparent electrodes 131 and 132. The metal electrodes 131' and 132' are disposed at both edges of the discharge cell. At this time, the pads 140 are preferably formed on the dielectric layer 110 corresponding to the metal electrodes 131' and 132' of the sustain electrode. That is to say, the respective pad 140 is disposed at the edge of the discharge cell.

The function of the pad 140 is as follows.

If a voltage is applied to the sustain electrode, discharge begins to occur in a region between the sustain electrodes of a discharge region of a discharge cell due to the potential difference between the first sustain electrodes 132 and 132' and the second sustain electrodes 131 and 131'. If the discharge is diffused into the overall discharge region, the electric field is applied to the pad 140 disposed at the edge of the discharge cell.

If the electric field is applied to the pad 140, discharge current rapidly flows. The discharge occurs in the discharge region of high resistance. On the other hand, the pad 140 has lower resistance than the discharge region because the pad 140 is of a conductive material such as Cr, Ag and Cu. As a result, the discharge current rapidly flows as compare with the discharge region, thereby resulting in that the discharge stops due to the rapid discharge current. That is to say, the pad 140 of a conductive material acts to suppress the discharge. For this reason, the discharge does not occur in a region where the pad 140 is formed, even if the distance between the adjacent sustain electrodes is narrow. This prevents interference between adjacent discharge cells from occurring, thereby preventing crosstalk of the plasma display panel from occurring. At this time, if the pad 140 is of not an opaque metal but a transparent metal such as ITO, crosstalk is avoided and at the same time luminance is prevented from being deteriorated.

If the scan pulse is applied to the first sustain electrodes 132 and 132' and the sustain pulse is applied to the second sustain electrodes 131 and 131', the first sustain electrodes 132 and 132' and the second sustain electrodes 131 and 131' are alternately formed as shown in FIG. 10. In this case, the barrier which divides pixels has a stripe shape which is generally used.

The plasma display panel according to the fifth embodiment of the present invention can be realized by the sixth embodiment according to arrangement relationship of the sustain electrodes.

Sixth Embodiment

Figure 11:
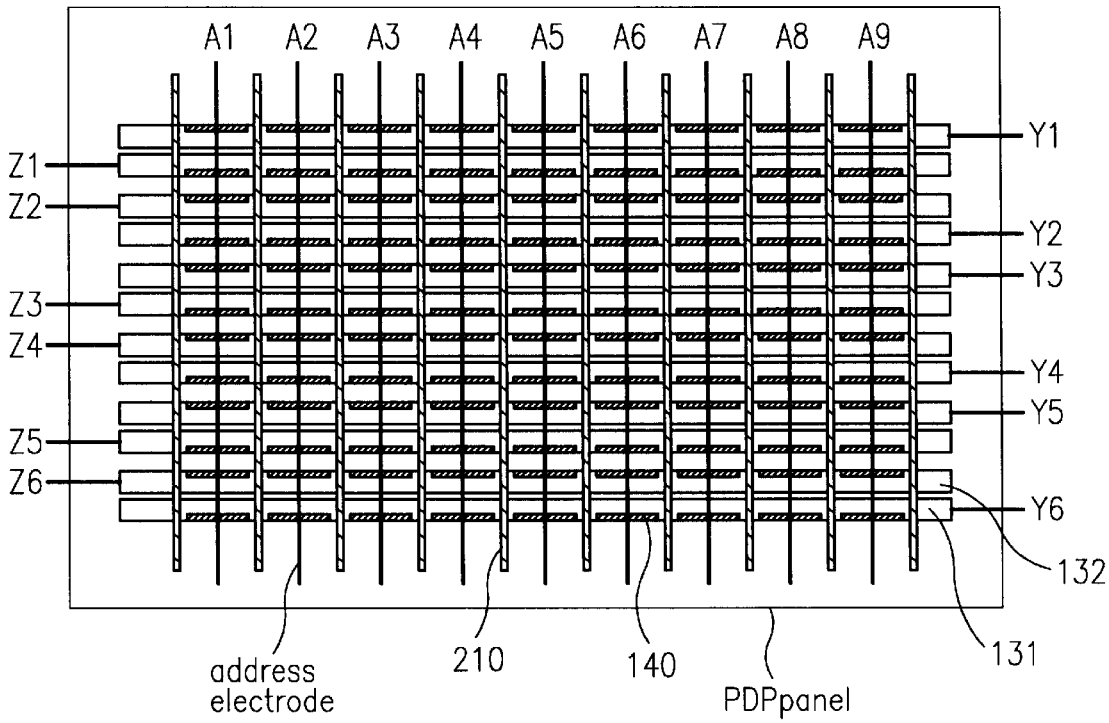
FIG. 11 is a layout illustrating a plasma display panel according to the sixth embodiment of the present invention.

FIG. 11 is a layout illustrating a plasma display panel according to the sixth embodiment of the present invention.

In the sixth embodiment of the present invention, the structure is the same as that of the fifth embodiment but arrangement of the sustain electrode is different from the fifth embodiment.

In the fifth embodiment of the present invention, the first sustain electrode and the second sustain electrode are alternately formed. On the other hand, in the sixth embodiment of the present invention, a pair of sustain electrodes in one discharge cell are alternately formed. That is, the same sustain electrodes are adjacent to each other between adjacent pairs of the sustain electrodes.

In FIG. 11, Y1, Y2, Y3, Y4, Y5, Y6, Y7, Y8, Y9, . . . denote the first sustain electrodes, and Z1, Z2, Z3, Z4, Z5, Z6, Z7, Z8, Z9, . . . denote the second sustain electrodes.

In the plasma display panel according to the sixth embodiment of the present invention, the first sustain electrodes 132 and 132' and the second sustain electrodes 131 and 131' constitute a pair. The distance between the first sustain electrodes and the second sustain electrodes is closer than the distance between adjacent pairs. The barriers 210 act to isolate a pair consisting of the first sustain electrodes 132 and 132' and the second sustain electrodes 131 and 131' from adjacent pairs. The pair consisting of the first sustain electrodes 132 and 132' and the second sustain electrodes 131 and 131' constitutes a discharge cell. The respective discharge cells are isolated from one another by the barriers 210.

Seventh Embodiment

Figure 12:
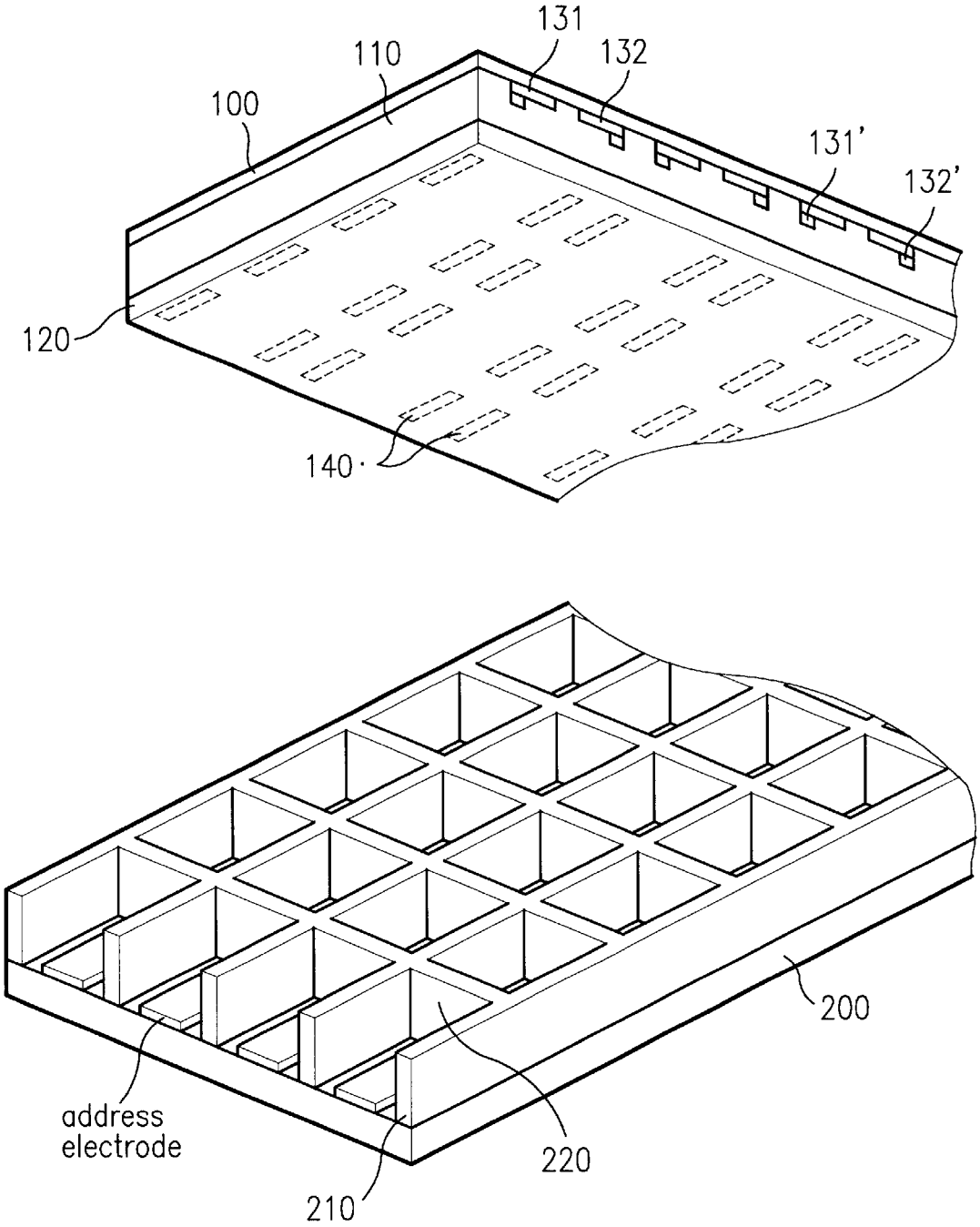
FIG. 12 is a perspective view illustrating a plasma display panel according to the seventh embodiment of the present invention.

FIG. 12 is a perspective view illustrating a plasma display panel according to the seventh embodiment of the present invention.

The seventh embodiment of the present invention is similar to the fifth embodiment of the present invention. In the seventh embodiment of the present invention, the barrier has a lattice shape. That is, the barrier includes a first barrier 210 formed in parallel to the sustain electrode and a second barrier successively formed between the respective first barriers to be orthogonal to the first barrier.

The plasma display panel according to the seventh embodiment of the present invention can be realized by the eighth embodiment according to arrangement relationship of the sustain electrodes.

Eighth Embodiment

Figure 13:
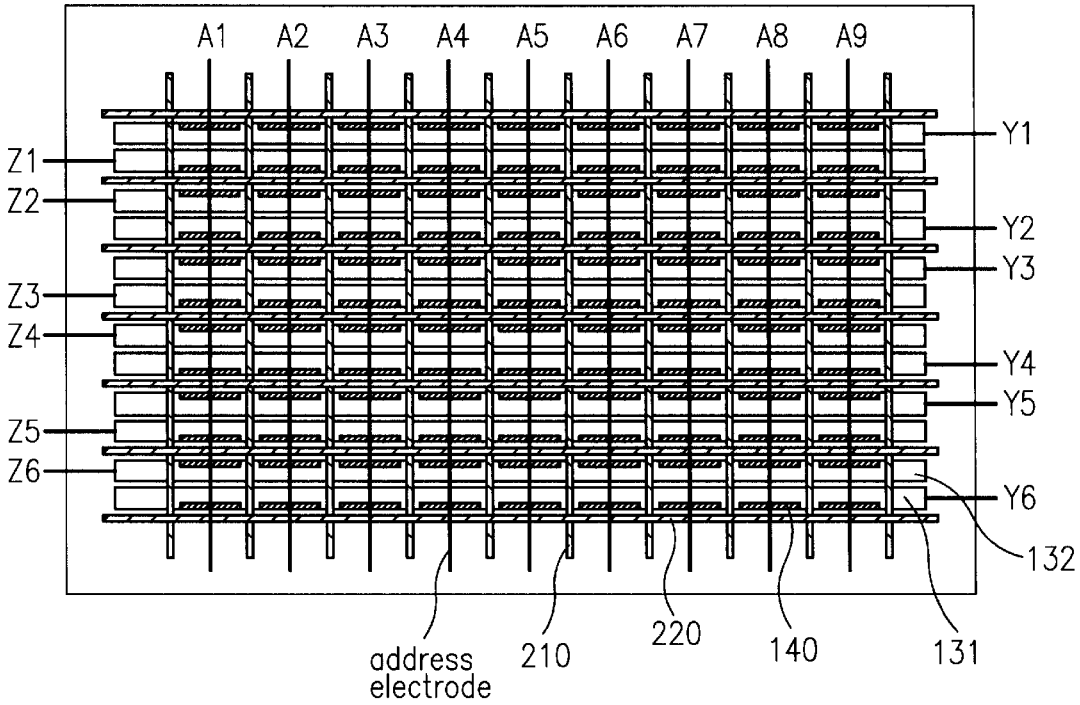
FIG. 13 is a layout illustrating a plasma display panel according to the eighth embodiment of the present invention.

FIG. 13 is a layout illustrating a plasma display panel according to the eighth embodiment of the present invention.

The eighth embodiment of the present invention is similar to the seventh embodiment of the present invention. In the eighth embodiment, arrangement of the sustain electrodes is different from that of the seventh embodiment.

In the seventh embodiment of the present invention, the first sustain electrode and the second sustain electrode are alternately formed. On the other hand, in the eighth embodiment of the present invention, a pair of sustain electrodes in one discharge cell are alternately formed. That is, the same sustain electrodes are adjacent to each other between adjacent pairs of the sustain electrodes.

In FIG. 13, Y1, Y2, Y3, Y4, Y5, Y6, Y7, Y8, Y9, . . . denote the first sustain electrodes, and Z1, Z2, Z3, Z4, Z5, Z6, Z7, Z8, Z9, . . . denote the second sustain electrodes.

In the plasma display panel according to the eighth embodiment of the present invention, the first sustain electrodes 132 and 132' and the second sustain electrodes 131 and 131' constitute a pair. The distance between the first sustain electrodes and the second sustain electrodes is closer than the distance between adjacent pairs. The second barriers 220 act to isolate a pair consisting of the first sustain electrodes 132 and 132' and the second sustain electrodes 131 and 131' from adjacent pairs. The pair consisting of the first sustain electrodes 132 and 132' and the second sustain electrodes 131 and 131' constitutes a discharge cell. The respective discharge cells are isolated from one another by the second barriers 220.

Ninth Embodiment

Figure 14:
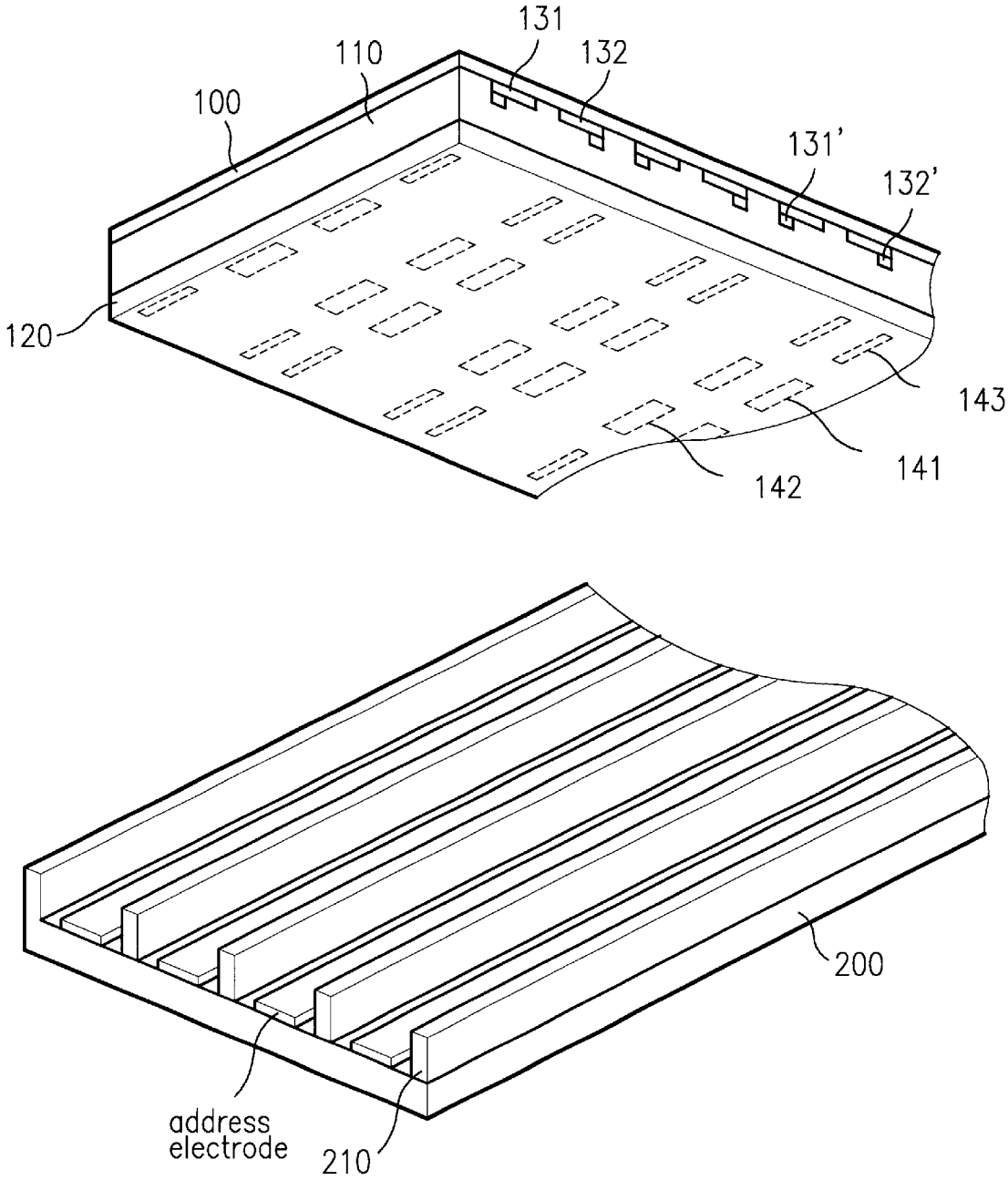
FIG. 14 is a perspective view illustrating a plasma display panel according to the ninth embodiment of the present invention.
Figure 18:
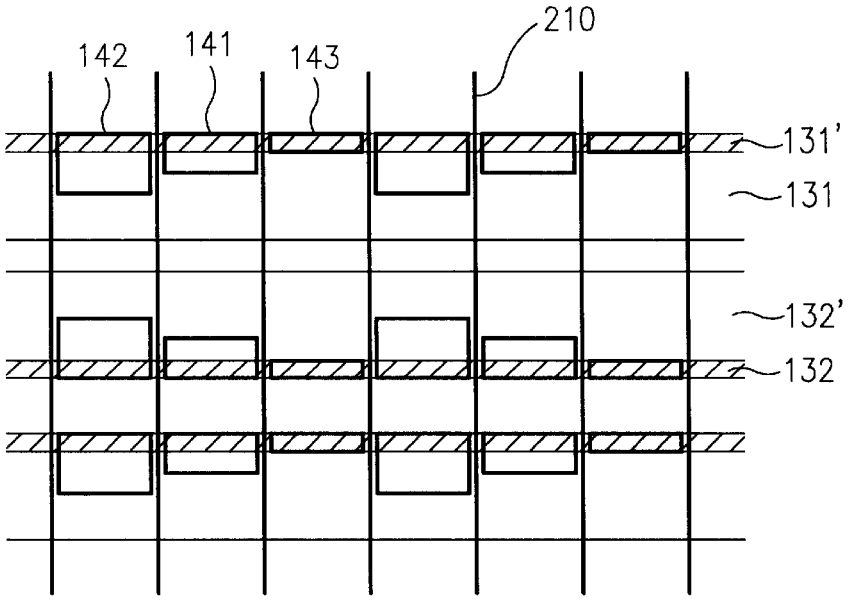
FIG. 18 is a layout illustrating a plasma display panel according to the ninth embodiment of the present invention.

FIG. 14 is a perspective view illustrating a plasma display panel according to the ninth embodiment of the present invention, and FIG. 18 is a layout illustrating a plasma display panel according to the ninth embodiment of the present invention.

In the ninth embodiment of the present invention, the sustain electrodes and the barriers are formed in the same manner as the fifth embodiment. However, pads 141, 142 and 143 are formed at different sizes for a discharge cell having a red phosphor, a discharge cell having a green phosphor, and a discharge cell having a blue phosphor.

In other words, the pads formed in the plasma display panel according to the ninth embodiment of the present invention includes a first pad 142 formed in the discharge cell having a green phosphor, a second pad 141 having a red phosphor and a third pad 143 having a blue phosphor, as shown in FIGS. 14 and 18.

At this time, it is preferable that the second pad 141 of the first, second and third pads 141, 142 and 143 is the widest and the third pad is the narrowest. This is because that light-emitting luminance of a red phosphor is relatively high and light-emitting luminance of a blue phosphor is relatively low.

If discharge conditions such as the size of the discharge cell, the width of the sustain electrode, and the size of the pad are the same, light-emitting luminance of a discharge cell having a red phosphor is relatively high and light-emitting luminance of a discharge cell having a blue phosphor is relatively low. As a result, purity of a white color becomes low, thereby distorting the white color.

Therefore, in the ninth embodiment of the present invention, the first pad 142, the second pad 141 and the third pad 143 are formed at different widths according to phosphors. That is, the first pad 142 is formed with a predetermined width in a discharge cell where a green phosphor will be formed. The second pad 141 is formed in a discharge cell where a red phosphor will be formed, and has a width of 100% to 130% of the first pad 142. The third pad 143 is formed in a discharge cell where a blue phosphor will be formed, and has a width of 70% to 90% of the first pad 142. Preferably, the second pad 141 has a width of 120% of the first pad 142, and the third pad 143 has a width of 80% of the first pad 142.

The first, second and the third pads 141, 142 and 143 have the same function as that of the fifth embodiment. However, the third pad 143 of the discharge cell having a blue phosphor has a smaller width than the first pad 142 and the second pad 141. Accordingly, discharge of the discharge cell where the third pad 143 is formed is less limited than the discharge cells where the first pad 142 and the second pad 141 are formed. Accordingly, the discharge cell where the third pad 143 is formed, i.e., the discharge cell having a blue phosphor has higher luminance than the discharge cell having the other phosphor.

Since the second pad 141 of the discharge cell having a red phosphor is wider than the first pad 142 and the third pad 143, discharge of the discharge cell where the second pad 141 is formed is more limited than the discharge cells where the first pad 142 and the third pad 143 are formed. Accordingly, the discharge cell where the second pad 141 is formed, i.e., the discharge cell having a red phosphor has lower luminance than the discharge cell having the other phosphor.

As aforementioned, since the discharge cell having a blue phosphor is brighter than the discharge cell having the other phosphor and the discharge cell having a red phosphor is darker than the discharge cell having the other phosphor, purity of white color displayed when the discharge cells are discharged under the same condition becomes higher.

Furthermore, since the respective pads 141, 142 and 143 suppress discharge, discharge does not occur in a region where the pads 141, 142 and 143 are formed even if the distance between the sustain electrodes is narrow, thereby preventing interference between adjacent discharge cells. As a result, crosstalk of the plasma display panel is avoided. At this time, if the pads are of not an opaque metal but a transparent metal such as ITO, crosstalk is avoided and at the same time deterioration of luminance is avoided.

The plasma display panel according to the ninth embodiment of the present invention can be realized by the tenth embodiment according to arrangement relationship of the sustain electrodes.

Tenth Embodiment

Figure 15:
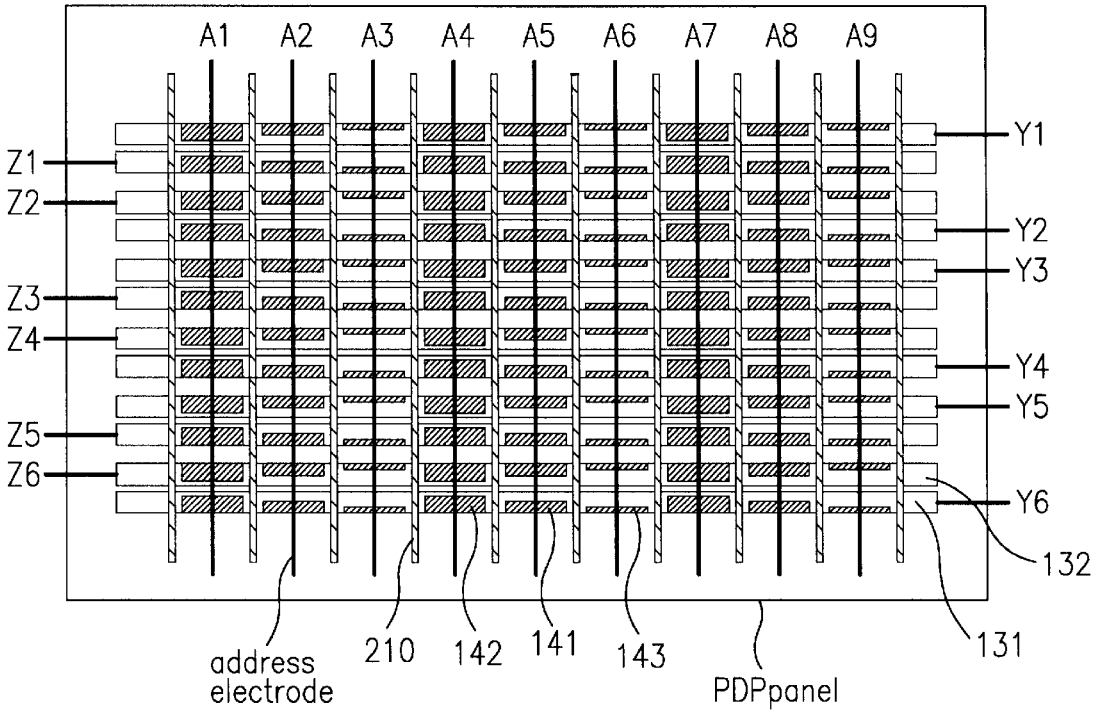
FIG. 15 is a layout illustrating a plasma display panel according to the tenth embodiment of the present invention.

FIG. 15 is a layout illustrating a plasma display panel according to the tenth embodiment of the present invention.

In the tenth embodiment of the present invention, the structure is the same as that of the ninth embodiment but arrangement of the sustain electrode is different from that of the ninth embodiment.

In the ninth embodiment of the present invention, the first sustain electrode and the second sustain electrode are alternately formed. On the other hand, in the tenth embodiment of the present invention, a pair of sustain electrodes in one discharge cell are alternately formed. That is, the same sustain electrodes are adjacent to each other between adjacent pairs of the sustain electrodes.

In FIG. 15, Y1, Y2, Y3, Y4, Y5, Y6, Y7, Y8, Y9, . . . denote the first sustain electrodes, and Z1, Z2, Z3, Z4, Z5, Z6, Z7, Z8, Z9, . . . denote the second sustain electrodes.

In the plasma display panel according to the tenth embodiment of the present invention, the first sustain electrodes 132 and 132' and the second sustain electrodes 131 and 131' constitute a pair. The distance between the first sustain electrodes and the second sustain electrodes is closer than the distance between adjacent pairs. The barriers 210 act to isolate a pair consisting of the first sustain electrodes 132 and 132' and the second sustain electrodes 131 and 131' from adjacent pairs. The pair consisting of the first sustain electrodes 132 and 132' and the second sustain electrodes 131 and 131' constitutes a discharge cell. The respective discharge cells are isolated from one another by the barriers 210.

Eleventh Embodiment

Figure 16:
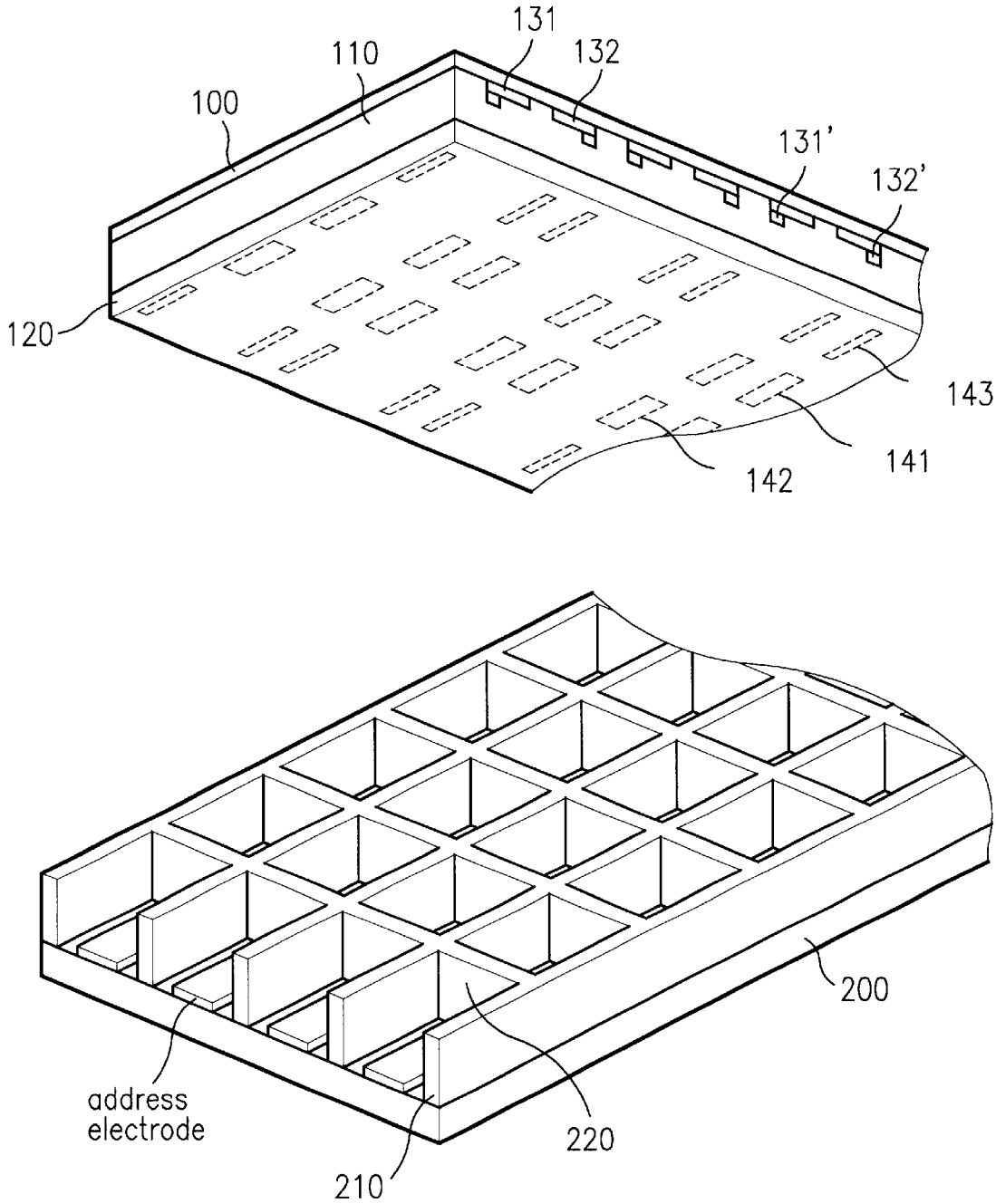
FIG. 16 is a perspective view illustrating a plasma display panel according to the eleventh embodiment of the present invention.

FIG. 16 is a perspective view illustrating a plasma display panel according to the eleventh embodiment of the present invention.

The eleventh embodiment of the present invention is similar to the ninth embodiment of the present invention. In the eleventh embodiment of the present invention, the barrier has a lattice shape. That is, the barrier includes first barriers 210 formed in parallel to the sustain electrode and second barriers successively formed between the respective first barriers to be orthogonal to the first barriers.

The plasma display panel according to the eleventh embodiment of the present invention can be realized by the twelfth embodiment according to arrangement relationship of the sustain electrodes.

Twelfth Embodiment

Figure 17:
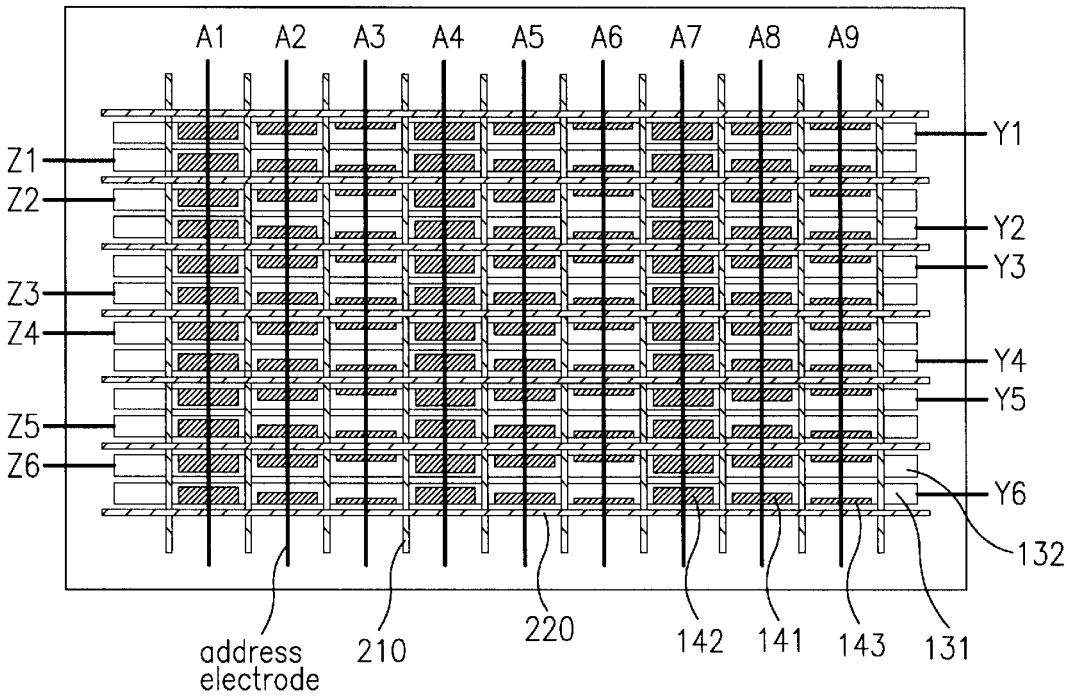
FIG. 17 is a layout illustrating a plasma display panel according to the twelfth embodiment of the present invention.

FIG. 17 is a layout illustrating a plasma display panel according to the twelfth embodiment of the present invention.

The twelfth embodiment of the present invention is similar to the eleventh embodiment of the present invention. In the twelfth embodiment, arrangement of the sustain electrodes is different from the eleventh embodiment.

In the eleventh embodiment of the present invention, the first sustain electrode and the second sustain electrode are alternately formed. On the other hand, in the twelfth embodiment of the present invention, a pair of sustain electrodes in one discharge cell are alternately formed. That is, the same sustain electrodes are adjacent to each other between adjacent pairs of the sustain electrodes.

In FIG. 17, Y1, Y2, Y3, Y4, Y5, Y6, Y7, Y8, Y9, . . . denote the first sustain electrodes, and Z1, Z2, Z3, Z4, Z5, Z6, Z7, Z8, Z9, . . . denote the second sustain electrodes.

In the plasma display panel according to the twelfth embodiment of the present invention, the first sustain electrodes 132 and 132' and the second sustain electrodes 131 and 131' constitute a pair. The distance between the first sustain electrodes and the second sustain electrodes is closer than the distance between adjacent pairs. The second barriers 220 act to isolate a pair consisting of the first sustain electrodes 132 and 132' and the second sustain electrodes 131 and 131' from adjacent pairs. The pair consisting of the first sustain electrodes 132 and 132' and the second sustain electrodes 131 and 131' constitutes a discharge cell. The respective discharge cells are isolated from one another by the second barriers 220.

As aforementioned, the plasma display panel of the present invention has the following advantages.

First, in the plasma display panel of the present invention, since an area occupied by the sustain electrode in the pixel region is larger as compared with the related art, higher luminance is obtained.

Second, since discharge current is suppressed by the dielectric layer thicker than the related art one, light-emitting efficiency can be improved.

Third, in the plasma display panel according to the fifth to twelfth embodiments of the present invention, the conductive pad which suppresses discharge is formed in the edge portion of each discharge cell, interference between adjacent discharge cells is reduced, thereby improving luminance and preventing crosstalk from occurring.

Finally, since the conductive pad formed in the discharge cell having a blue phosphor is the narrowest and the conductive pad formed in the discharge cell having a red phosphor is the widest, luminance of the discharge cell having the blue phosphor is the highest and luminance of the discharge cell having the red phosphor is the lowest. Thus, purity of white color displayed when the discharge cells are discharged under the same condition becomes higher.

Consequently, the plasma display panel of the present invention can reduce power consumption and prevent crosstalk from occurring. At the same time, the plasma display panel having an improved luminance and color purity can be obtained.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel comprising:

a plurality of first barriers successively formed on a predetermined substrate at predetermined intervals;

a plurality of first sustain electrodes formed at a combined width more than 40% of a pixel pitch, which is an overall distance of four of the barriers, to be orthogonal to the first barriers;

a plurality of second sustain electrodes spaced apart from the first sustain electrodes at a combined distance less than 20% of the pixel pitch and mated with the first sustain electrodes one by one;

a dielectric layer formed at a thickness of 25 $\mu$m or more to cover the first and second sustain electrodes; and a plurality of pads of a conductive material formed on some of the dielectric layer corresponding to the respective sustain electrodes, having different sizes for discharge cells displaying red, green and blue.

2. The plasma display panel as claimed in claim 1, wherein the first sustain electrodes and the second sustain electrodes are alternately formed.

3. The plasma display panel as claimed in claim 1, wherein one of the first sustain electrodes and one of the second sustain electrodes constitute a pair, and a pair of the sustain electrodes are arranged in different positions from the sustain electrodes of adjacent pairs.

4. The plasma display panel as claimed in claim 1, further comprising a plurality of second barriers successively formed to be orthogonal to the first barriers so that the first and second sustain electrodes are arranged in pairs.

5. The plasma display panel as claimed in claim 1, wherein the first sustain electrode and the second sustain electrode are of a transparent electrode having a predetermined width and a metal electrode having a smaller width than the transparent electrode to partially overlap the transparent electrode.

6. The plasma display panel as claimed in claim 5, wherein the respective pad is formed in some portion on the dielectric layer corresponding to the metal electrode.

7. The plasma display panel as claimed in claim 1, wherein the conductive material is of metal or transparent electrode.

8. The plasma display panel as claimed in claim 1, wherein the pad includes a first pad formed with a predetermined width.

9. An apparatus comprising:

a plurality of electrodes arranged substantially on a first plane with a plurality of gaps on the first plane between each adjacent electrode of the plurality of electrodes, wherein a total surface area of the plurality of gaps on the plane is less than 25% of the surface area of the electrodes on the first plane;

a dielectric layer over the plurality of electrodes; and a plurality of conductive sections formed over the dielectric layer and arranged substantially on a second plane, wherein the first plane is substantially parallel to the second plane, and wherein:

the plurality of electrodes drive a plurality of display cells; and the surface area of each conductive section of the plurality of conductive sections corresponds to a color of a display cell of the plurality of display cells.

10. The apparatus of claim 9, wherein a surface area of a conductive section of the plurality of conductive section associated with a red display cell of the plurality of display cells is larger than a surface area of a conductive section of the plurality of conductive section associated with a green display cell of the plurality of display cells.

11. The apparatus of claim 10, wherein the surface area of the conductive section associated with the red display cell is in a range of 100% to 130% of the surface area of the conductive section associated with the green display cell.

12. The apparatus of claim 11, wherein the surface area of the conductive section associated with the red display cell is 120% of the surface area of the conductive section associated with the green display cell.

13. The apparatus of claim 9, wherein a surface area of a conductive section of the plurality of conductive sections associated with a green display cell of the plurality of display cells is larger than a surface area of a conductive section of the plurality of conductive sections associated with a blue display cell of the plurality of display cells.

14. The apparatus of claim 13, wherein the surface area of the conductive section associated with the blue display cell is in a range of 70% to 90% of the surface area of the conductive section associated with the green display cell.

15. The apparatus of claim 14, wherein the surface area of the conductive section associated with the blue display cell is 80% of the surface area of the conductive section associated with the green display cell.

16. The apparatus of claim 9, wherein a surface area of a conductive section of the plurality of conductive section associated with a red display cell of the plurality of display cells is larger than a surface area of a conductive section of the plurality of conductive sections associated with a blue display cell of the plurality of display cells.

17. A plasma display device comprising:

a plurality of display cells; and a means for preventing crosstalk between the display cells.

* * * * *